US008613632B1

(12) United States Patent
Nichols

(10) Patent No.: US 8,613,632 B1
(45) Date of Patent: Dec. 24, 2013

(54) ELECTRICAL CONNECTOR ASSEMBLY HAVING THERMAL VENTS

(75) Inventor: Robert Paul Nichols, Santa Rosa, CA (US)

(73) Assignee: Tyco Electronics Corporation, Berwyn, PA (US)

( * ) Notice: Subject to any disclaimer, the term of this patent is extended or adjusted under 35 U.S.C. 154(b) by 6 days.

(21) Appl. No.: 13/528,447

(22) Filed: Jun. 20, 2012

(51) Int. Cl.
*H01R 13/648* (2006.01)

(52) U.S. Cl.
USPC ..... 439/607.21; 439/485

(58) Field of Classification Search
USPC ..... 439/76.1, 676, 607.04, 607.13, 607.21, 439/485
See application file for complete search history.

(56) References Cited

U.S. PATENT DOCUMENTS

| | | | | |
|---|---|---|---|---|
| 6,350,152 | B1 * | 2/2002 | Belopolsky et al. | 439/541.5 |
| 7,189,119 | B2 * | 3/2007 | Blichasz et al. | 439/638 |
| D548,192 | S * | 8/2007 | Wan et al. | D13/147 |
| 7,261,591 | B2 * | 8/2007 | Korsunsky et al. | 439/541 |
| D580,361 | S * | 11/2008 | Zheng et al. | D13/147 |
| 7,481,677 | B1 * | 1/2009 | Yi et al. | 439/607.01 |
| 8,469,744 | B2 * | 6/2013 | Nichols et al. | 439/607.01 |

* cited by examiner

*Primary Examiner* — Neil Abrams
*Assistant Examiner* — Phuongchi T Nguyen

(57) ABSTRACT

An electrical connector assembly includes a cage member with walls that define an upper port and a lower port. The cage member has openings in a front thereof for receiving pluggable modules. A receptacle connector is received in the cage member proximate to a rear thereof. The electrical connector assembly includes a printed circuit board having a first surface and a second surface. The printed circuit board has at least one thermal vent that extends therethrough between the first and second surfaces. At least one thermal vent provides cooling for the lower port.

20 Claims, 6 Drawing Sheets

ELECTRICAL CONNECTOR ASSEMBLY HAVING THERMAL VENTS

BACKGROUND OF THE INVENTION

The subject matter herein relates generally to connector systems for pluggable electronic modules, such as transceiver modules, for high speed fiber optical and copper communications.

It is known to provide a metal cage with a plurality of ports, whereby transceiver modules are pluggable therein. Several pluggable module designs and standards have been introduced in which a pluggable module plugs into a receptacle which is electronically connected to a host circuit board. For example, a well-known type of transceiver developed by an industry consortium is known as a gigabit interface converter (GBIC) or serial optical converter (SOC) and provides an interface between a computer and a data communication network such as Ethernet or a fiber network. These standards offer a generally robust design which has been well received in industry.

It is desirable to increase the port density associated with the network connection, such as, for example, switch boxes, cabling patch panels, wiring closets, and computer I/O. Recently, a new standard has been promulgated and is referred to herein as the small form factor pluggable (SFP) standard which specifies an enclosure height of 9.8 mm and a width of 13.5 mm and a minimum of 20 electrical input/output connections. Another standard is referred to as the Quad Small Form-factor Pluggable (QSFP) standard.

It is also desirable to increase the operating frequency of the network connection. For example, applications are quickly moving to the multi-gigabit realm. Electrical connector systems that are used at increased operating speeds present a number of design problems, particularly in applications in which data transmission rates are high, e.g., in the range above 10 Gbs (Gigabits/second). One concern with such systems is reducing electromagnetic interference (EMI) emissions. Another concern is reducing operating temperatures of the transceivers.

In conventional designs, thermal cooling is achieved by using a heat sink and/or airflow over the shielded metal cage surrounding the receptacles. However, the thermal cooling provided by conventional designs are proving to be inadequate, particularly for the transceivers in the lower row. Therefore, there is a need for a connector system design that conforms to the SFP standard or the QSFP standard or another standard, while providing adequate thermal cooling of transceivers.

BRIEF DESCRIPTION OF THE INVENTION

In one embodiment, an electrical connector assembly is provided having a cage member that has a plurality of walls that define an upper port and a lower port configured to receive pluggable modules therein. The walls are manufactured from a metal material and provide electrical shielding for the upper port and the lower port. The cage member has openings in a front thereof for receiving the pluggable modules. A receptacle connector is received in the cage member proximate to a rear thereof. The receptacle connector is accessible through at least one of the upper port and the lower port. The electrical connector assembly also includes a printed circuit board having a first surface and a second surface. The receptacle connector is terminated to the printed circuit board. The cage member is coupled to the printed circuit board. The printed circuit board has at least one thermal vent that extends therethrough between the first and second surfaces. The at least one thermal vent provides cooling for the lower port.

In another embodiment, an electrical connector assembly is provided having a cage member that has a plurality of walls that define an upper port and a lower port configured to receive pluggable modules therein. The walls are manufactured from a metal material and provide electrical shielding for the upper port and the lower port. The cage member has openings in a front thereof for receiving the pluggable modules. A receptacle connector is received in the cage member proximate to a rear thereof. The receptacle connector is accessible through at least one of the upper port and the lower port. A printed circuit board has a first surface and a second surface. The receptacle connector is terminated to the printed circuit board. The cage member is coupled to the printed circuit board. The printed circuit board has at least one thermal vent that extends through the printed circuit board between the first and second surfaces. The thermal vent provides cooling for the lower port. A front bezel has an assembly opening therethrough. The printed circuit board and cage member are mounted behind the front bezel with the front of the cage member extending through the assembly opening. The front bezel has at least one bezel thermal vent therethrough. The bezel thermal vent is positioned below the assembly opening and below the printed circuit board.

In a further embodiment, an electrical connector assembly is provided having a printed circuit board that has a first surface and a second surface. The printed circuit board has at least one thermal vent that extends therethrough between the first and second surfaces. A receptacle connector is mounted to the first surface of the printed circuit board. The receptacle connector is configured to be mated with a transceiver module. A cage member is mounted to the first surface of the printed circuit board. The cage member has a plurality of walls that define a port that receives the receptacle connector and configured to receive the transceiver module therein. The walls are manufactured from a metal material and provide electrical shielding for the port. The cage member is mounted to the printed circuit board such that an airflow space is created between a bottom of the cage member and the first surface of the printed circuit board. The airflow space is in fluid communication with the at least one thermal vent of the printed circuit board.

DETAILED DESCRIPTION OF THE INVENTION

Figure 1:
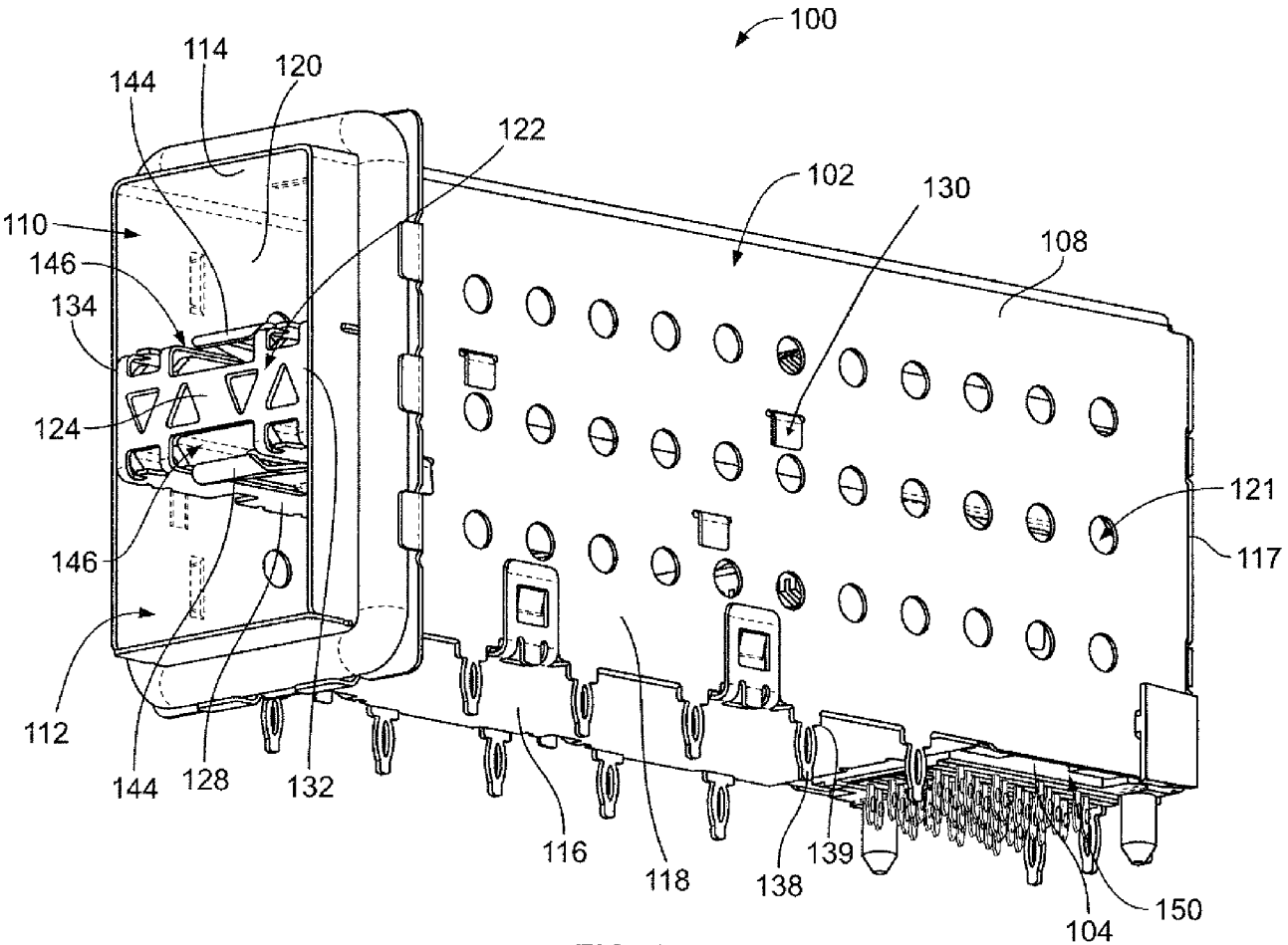
FIG. 1 is a front perspective view of an electrical connector assembly formed in accordance with an exemplary embodiment.

FIG. 1 is a front perspective view of an electrical connector assembly 100 formed in accordance with an exemplary embodiment. The electrical connector assembly 100 includes a cage member 102 and a receptacle connector 104 received in the cage member 102. Pluggable modules 106 (shown in FIG. 3) are configured to be loaded into the cage member 102 for mating with the receptacle connector 104. The receptacle connector 104 is intended for placement on a circuit board, such as a motherboard, and is arranged within the cage member 102 for mating engagement with the pluggable modules 106.

The cage member 102 is a shielded, stamped and formed cage member that includes a plurality of shielded walls 108 that define multiple ports 110, 112 for receipt of the pluggable modules 106. In the illustrated embodiment, the cage member 102 constitutes a stacked cage member having the ports 110, 112 in a stacked configuration. The port 110 defines an upper port positioned above the port 112 and may be referred to hereinafter as upper port 110. The port 112 defines a lower port positioned below the port 110 and may be referred to hereinafter as lower port 112. Any number of ports may be provided in alternative embodiments. In the illustrated embodiment, the cage member 102 includes the ports 110, 112 arranged in a single column, however, the cage member 102 may include multiple columns of ports 110, 112 in alternative embodiments (e.g. 2X2, 3X2, 4X2, 4X3, etc.). In other alternative embodiments, the cage member 102 may include a single port or may include ports arranged in a single row (e.g. non-stacked).

The cage member 102 includes a top wall 114, a lower wall 116, a rear wall 117 and side walls 118, 120, which together define the general enclosure for the cage member 102. Optionally, the cage member 102 may not include the lower wall 116, but rather may have an open bottom. In an exemplary embodiment, the shielded walls 108 may include airflow openings 121 therethrough. The airflow openings 121 promote airflow through the shielded walls 108 to help cool the shielded walls 108, the ports 110, 112 and/or the pluggable modules 106. Any of the shielded walls 108, including the lower wall 116, may include airflow openings 121. The airflow openings 121 may have any size and shape. In an exemplary embodiment, the size, shape, spacing and/or positioning of the airflow openings 121 may be selected with consideration to thermal performance, shielding performance (e.g. electromagnetic interference (EMI) shielding), electrical performance, or other design considerations.

The cage member 102 is subdivided by a center separator member 122 to define the upper and lower ports 110, 112. The separator member 122 extends between the side walls 118, 120. The separator member 122 has a front wall 124 with an upper plate 126 and a lower plate 128 extending rearward from the front wall 124. A channel is defined between the upper and lower plates 126, 128 rearward of the front wall 124. The upper and lower plates 126, 128 are spaced apart from one another defining an air gap through the channel. The separator member 122 is retained in place by tabs 130, which extend from side edges 132, 134 of the upper and lower plates 126, 128, and which extend through the side walls 118, 120.

The cage member 102 has numerous features allowing the grounding of the cage member 102 to a motherboard and/or a front bezel. The lower wall 116 and side walls 118, 120 include mounting posts or tines 138 extending therefrom that are configured to be received in plated ground vias of the motherboard to electrically ground the cage member 102 to the ground plane of the motherboard. In the illustrated embodiment, the tines 138 have shoulders 139 that act as mechanical stops to loading the tines 138 into the plated ground vias. The depth of the shoulders 139 from the lower wall 116 may control the positioning of the lower wall 116 from the motherboard. For example, the shoulders 139 may be a predetermined distance from the lower wall 116, which may position the lower wall 116 a distance from the motherboard, allowing an airflow space or gap between the lower wall 116 and the motherboard. The tines 138 are profiled to both mechanically hold the cage member 102 to the motherboard as well as to ground the cage member 102 thereto. Similar features may extend from the lower wall 116 and provide grounding of the cage member 102 to the motherboard. Around the perimeter of the cage member 102 towards the front edge thereof, the cage member 102 may include a plurality of resilient tabs, which are profiled to engage an edge of an opening through which the cage member 102 is inserted, such as an opening in a panel or chassis.

The separator member 122 includes latches 144 adjacent a front edge thereof for grounding the pluggable module 106 and the cage member 102. Additionally, the latches 144 have latch openings 146 for latching engagement with the pluggable module 106. The latches 144 are deflectable and are stamped from the upper and lower plates 126, 128.

In an exemplary embodiment, the lower wall 116 is shorter than the other walls defining a rear opening 150 between the rear edge of the lower wall 116 and the rear wall 117. Alternatively, the rear opening 150 may extend through the lower wall 116. The receptacle connector 104 is received in the rear opening 150. The receptacle connector 104 is accessible through the lower port 112 and the upper port 110. The separator member 122 does not extend to the rear wall 117, but rather stops short of the rear wall 117 to provide a space for the receptacle connector 104 to be loaded into the upper port 110. In an alternative embodiment, more than one receptacle connector may be provided, one extending into the lower port 112, the other extending through the lower port 112 into the upper port 110.

Figure 2:
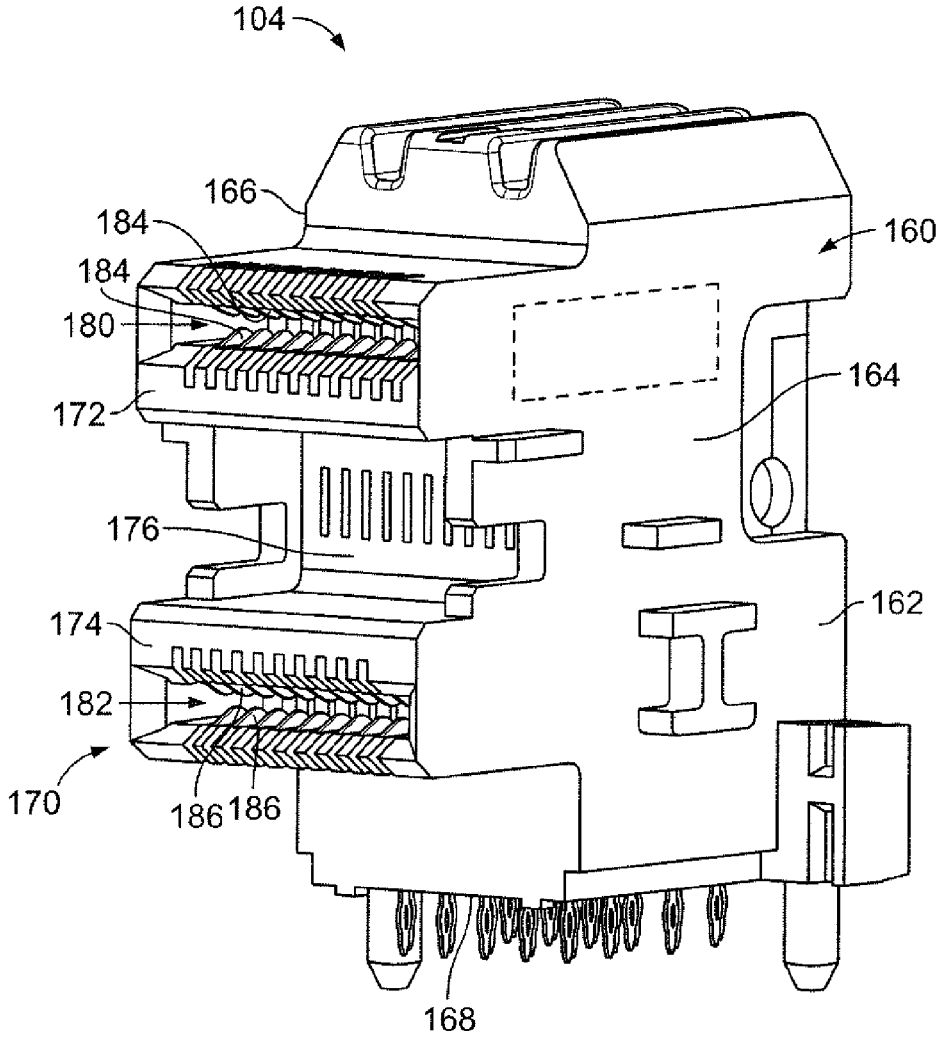
FIG. 2 is a front perspective view of the receptacle connector shown in FIG. 1.

FIG. 2 is a front perspective view of the receptacle connector 104. The receptacle connector 104 includes a housing 160 defined by an upstanding body portion 162 having side walls 164, 166, a lower face 168 configured to be mounted to the motherboard, and a mating face 170. Upper and lower extension portions 172 and 174 extend from the body portion 162 to define the mating face 170. A recessed face 176 is defined between the upper and lower extensions 172, 174 at the front face of the body portion 162.

Circuit card receiving slots 180 and 182 extend inwardly from the mating face 170 of each of the respective upper and lower extensions 172, 174, and extend inwardly to the housing body 160. The circuit card receiving slots 180, 182 are configured to receive a card edge of the pluggable module 106 (shown in FIG. 3). A plurality of contacts 184 are held by the housing 160 and are exposed within the circuit card receiving slot 180 for mating with the corresponding pluggable module 106. The contacts 184 extend from the lower face 168 and are terminated to the motherboard. For example, the ends of the contacts 184 may constitute pins that are loaded into plated vias of the motherboard. Alternatively, the contacts 184 may be terminated to the motherboard in another manner, such as by surface mounting to the motherboard. A plurality of contacts 186 are held by the housing 160 and are exposed within the circuit card receiving slot 182 for mating with the corresponding pluggable module 106. The contacts 186 extend from the lower face 168 and are terminated to the motherboard.

Figure 3:
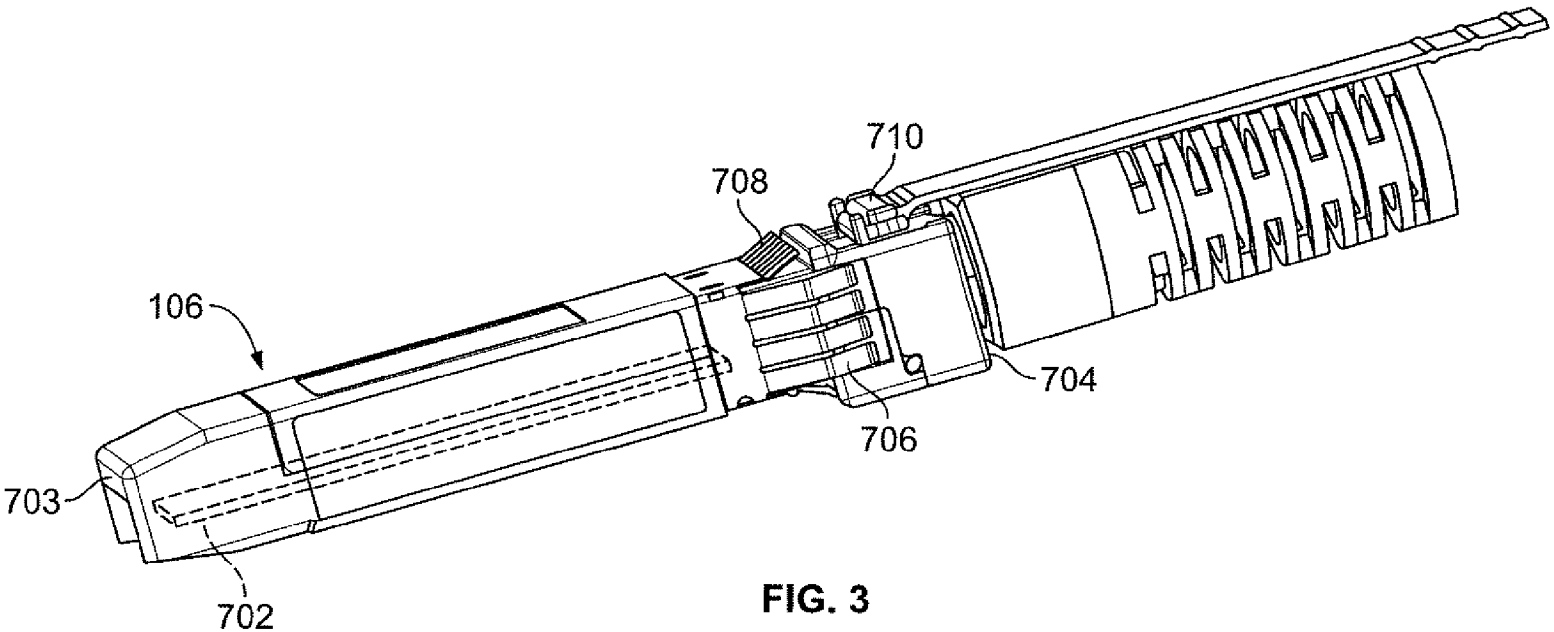
FIG. 3 illustrates a pluggable module for use with electrical connector assembly shown in FIG. 1.

FIG. 3 illustrates a pluggable module 106 for use with electrical connector assembly 100 (shown in FIG. 1). In the illustrated embodiment, the pluggable module 106 constitutes a small form-factor pluggable (SFP) module having a circuit card 702 at a mating end 703 thereof for interconnection into the slots 180, 182 (shown in FIG. 2) and into interconnection with the contacts 184 or 186 (shown in FIG. 2) therein. The pluggable module 106 would further include an electrical interconnection within the module to an interface at end 704, such as a copper interface in the way of a modular jack, or to a fiber optic connector for further interfacing. The pluggable module 106 would also include grounding tabs 706, 708, and a raised embossment 710. The embossment 710 would latch into the triangular shaped opening of the latch 144 (shown in FIG. 1). This allows for easy extraction of the pluggable module 106 as the latches 144 are accessible from the front end of the corresponding cage member 102. Other types of pluggable modules or transceivers may be utilized in alternative embodiments.

Figure 4:
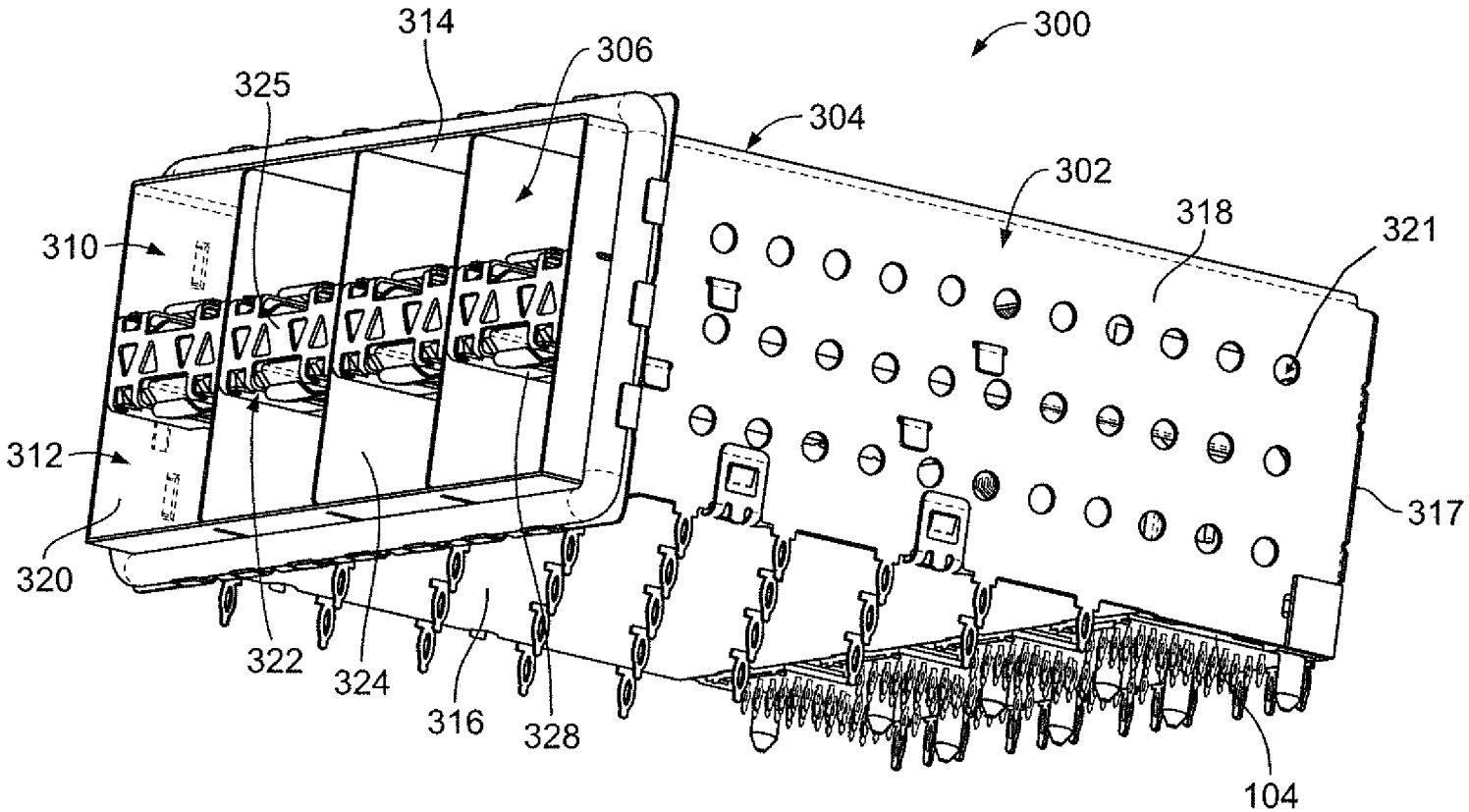
FIG. 4 is a front perspective view from an underside of an electrical connector assembly showing a cage member and a plurality of the receptacle connectors.

FIG. 4 is a front perspective view from an underside of an alternative electrical connector assembly 300 showing a cage member 302 and a plurality of the receptacle connectors 104. Pluggable modules 106 (shown in FIG. 3) are configured to be loaded into the cage member 302 for mating with the receptacle connector 104.

The cage member 302 is a shielded, stamped and formed cage member that includes a plurality of exterior shielded walls 304 and a plurality of interior shielded walls 306 defining the cage member 302. The cage member 302 differs from the cage member 102 (shown in FIG. 1) in that the cage member 302 includes more ports. The cage member 302 includes a plurality of upper ports 310 and a plurality of lower ports 312. While four columns of ports 310, 312 are shown, it is realized that any number of columns of ports may be provided in alternative embodiments.

The exterior shielded walls 304 include a top wall 314, a lower wall 316, a rear wall 317 and side walls 318, 320, which together define the general enclosure for the cage member 302. Optionally, the cage member 302 may not include the lower wall 316, but rather may have an open bottom. In an exemplary embodiment, the exterior shielded walls 304 may include airflow openings 321 therethrough. The airflow openings 321 promote airflow through the exterior shielded walls 304 to help cool the exterior shielded walls 304, the ports 310, 312 and/or the pluggable modules 106. Any of the exterior shielded walls 304, including the lower wall 316, may include airflow openings 321. The airflow openings 321 may have any size and shape. In an exemplary embodiment, the size, shape, spacing and/or positioning of the airflow openings 321 may be selected with consideration to thermal performance, shielding performance (e.g. electromagnetic interference (EMI) shielding), electrical performance, or other design considerations.

The interior shielded walls 306 include separator members 322 between the rows of ports 310, 312 and divider walls 324 between the columns of ports 310, 312. The separator members 322 extend between one of the side walls 318, 320 and one of the divider walls 324 or between adjacent ones of the divider walls 324. The interior shielded walls 306, including the separator members 322 and/or the divider walls 324 may include airflow openings therethrough. The airflow openings through the interior shielded walls 306 promote airflow to help cool the interior shielded walls 306, the ports 310, 312 and/or the pluggable modules 106.

The separator member 322 has a front wall 325 with an upper plate 326 and a lower plate 328 extending rearward from the front wall 325. A channel is defined between the upper and lower plates 326, 328 rearward of the front wall 325. The upper and lower plates 326, 328 are spaced apart from one another defining an air gap through the channel.

Figure 5:
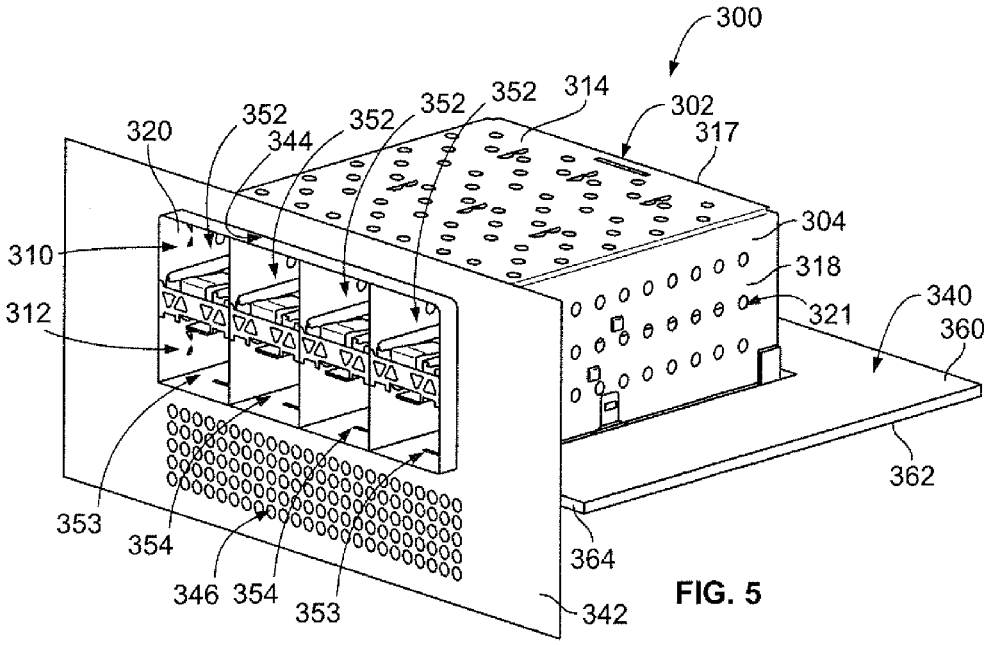
FIG. 5 is a front perspective view of the electrical connector assembly shown in FIG. 4 mounted to a printed circuit board.

FIG. 5 is a front perspective view of the electrical connector assembly 300 mounted to a printed circuit board 340. FIG. 5 illustrates a front bezel 342, which may be part of a chassis or device that holds the electrical connector assembly 300. The printed circuit board 340 includes a first surface 360 and a second surface 362 opposite the first surface 360. The cage member 302 and receptacle connectors 104 are mounted to the first surface 360 of the printed circuit board 340. The printed circuit board 340 has a front edge 364. The front bezel 342 is positioned forward of the front edge 364.

A portion of the electrical connector assembly 300 extends through a bezel opening 344 in the front bezel 342, with the remainder of the electrical connector assembly 300 behind the front bezel 342. The pluggable modules 106 may be loaded into the ports 310, 312 through the front bezel 342. The ports 310, 312 are exposed through the bezel opening 344. The printed circuit board 340 is also located behind the front bezel 342. In an exemplary embodiment, the front bezel 342 includes a plurality of bezel thermal vents 346 extending through the front bezel 342. The bezel thermal vents 346 allow airflow through the front bezel 342. In the illustrated embodiment, the bezel thermal vents 346 are provided below the bezel opening 344. The bezel thermal vents 346 are provided below the printed circuit board 340 and allow airflow below the printed circuit board 340. The bezel thermal vents 346 promote venting and/or cooling of the interior of the chassis where the electrical connector assembly 300 and printed circuit board 340 are located.

During use, the pluggable modules 106 generate heat. It is desirable to remove the heat generated by the pluggable modules 106 so that the pluggable modules 106 can operate at higher performance levels. The heat generated by the pluggable modules 106 is thermally transferred to the cage member 302. Airflow along the exterior shielded walls 304 cools the cage member 302, allowing more heat transfer from the pluggable modules 106. The airflow around the cage member 302 may be forced, such as by a fan or other component mounted proximate to the cage member 302. The airflow opening 321 and the exterior shield walls 304 allow some airflow into the ports 310, 312, which helps to reduce the temperature of the pluggable modules 106.

In the illustrated embodiment, the electrical connector assembly 300 includes four upper ports 310 and four lower ports 312. The cage member 302 is mounted to the printed circuit board 340 such that the lower ports 312 are provided proximate to the printed circuit board 340. The printed circuit board 340 generally functions as a thermal insulator, limiting heat transfer from the bottom of the cage member 302. In an exemplary embodiment, the printed circuit board 340 includes a plurality of thermal vents 350 (shown in FIG. 6) through the printed circuit board 340. The thermal vents 340 allow airflow through the printed circuit board 340. The airflow through the thermal vents 350 reduces the temperature of the cage member 302. The airflow through the thermal vents 350 reduces the temperature of lower wall 316 (shown in FIG. 4). The airflow through the thermal vents 350 reduces the temperature in the lower ports 312. The airflow through the thermal vents 350 reduces the temperature of the pluggable modules in the lower ports 312.

Heat transfer from the ports 310, 312 varies based upon the location of the particular port 310, 312. Heat transfer from the ports 310, 312 is at least partially dependent upon the surface area of the exterior shielded walls 304 surrounding the particular port 310, 312. The thermal efficiency of the cage member 302, and thus the amount of heat transfer from a particular port 310, 312 is as at least partially dependent on the amount of airflow over the exterior shielded walls 304. For example, the top wall 314, the rear wall 317 and the side walls 318, 320 tend to have a higher amount of airflow along the surfaces of such walls. In contrast, the lower wall 316 tends to have less airflow along the surface of the lower wall 316. Providing the thermal vents 350 through the printed circuit board 340 increases the amount of airflow along the lower wall 316, which increases the amount of heat transfer by the lower wall 316. Additionally, having the bezel vents 346 below the printed circuit board 340 increases the amount of airflow below the printed circuit board 340. Increasing the airflow below the printed circuit board 340 increases the amount of airflow through and/or past the thermal vents 350 in the printed circuit board 340.

The cage member 302 includes a plurality of exterior upper ports 352, a plurality of exterior lower ports 353 and a plurality of interior lower ports 354. The exterior ports 352, 353 are defined as having at least one exterior shielded wall defined by the top wall 314, the side wall 318 and/or the side wall 320. The interior lower ports 354 are not surrounded by any of the top wall 314, the side wall 318 or the side wall 320. The interior lower ports 354 tend to be the hot spots having less exposure to airflow. The exterior ports 352, 353 tend to be more thermally efficient at dissipating heat from the pluggable modules 106 therein because a greater amount of air flows along the exterior shield walls 304 of the exterior ports 352, 353.

The thermal vents 350 in the printed circuit board 340 are aligned below the interior lower ports 354 to increase airflow along the lower walls 316 of the interior lower ports 354. Optionally, the thermal vents 350 may be provided below only the interior lower ports 354. In other embodiments, the thermal vents 350 may be aligned below both the interior lower ports 354 and the exterior lower ports 353. For example, the thermal vents 350 may be aligned below all of the lower ports 312.

Figure 6:
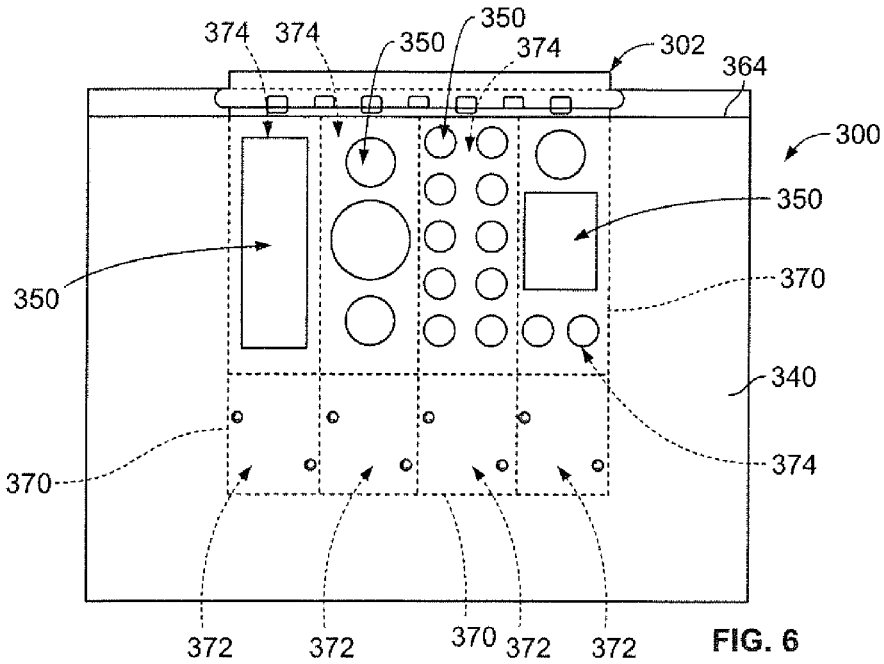
FIG. 6 is a bottom view of the electrical connector assembly shown in FIG. 4.

FIG. 6 is a bottom view of the electrical connector assembly 300. FIG. 6 illustrates a plurality of thermal vents 350 through the printed circuit board 340. Different examples (e.g., different size, shape, position, etc.) of thermal vents 350 are illustrated in FIG. 6.

The cage member 302 is mounted to the printed circuit board 340. The cage member 302 has a footprint 370 on the printed circuit board 340. The footprint 370 is generally defined by the side walls 318, 320 (shown in FIG. 4) and the rear wall 317 (shown in FIG. 4).

The receptacle connectors 104 (shown in FIG. 2) are mounted on the printed circuit board 340 inside the area defined by the footprint 370. The printed circuit board 340 defines individual connector mounting areas 372 for the receptacle connectors 104. The connector mounting areas 372 are remote from the front edge 364.

Intermediate areas 374 are defined between the connector mounting areas 372 and the front edge 364. The thermal vents 350 are arranged in the intermediate areas 374. Optionally, the thermal vents 350 may span across the interface between adjacent intermediate areas 374 such that a single thermal vent 350 is arranged in both adjacent intermediate areas 374. The interfaces between the adjacent intermediate areas 374 are generally aligned along the divider walls 324 (shown in FIG. 4). When the pluggable modules 106 (shown in FIG. 3) are loaded into the cage member 302, the pluggable modules 106 are generally aligned above the intermediate areas 374. The intermediate areas 374 are the areas of the printed circuit board 340 in which cooling may be desired.

The thermal vents 350 extend through the printed circuit board 340 in the intermediate areas 374. Optionally, the thermal vents 350 may encompass more than 10% of the surface area defined by the intermediate areas 374. In some embodiments, the thermal vents 350 may encompass at least 25% of the surface area defined by the intermediate areas 374. In some embodiments, the thermal vents 350 may encompass at least 50% of the surface area defined by the intermediate areas 374. In some embodiments, the thermal vents 350 may encompass at least 75% of the surface area defined by the intermediate areas 374. In some embodiments, the thermal vents 350 may encompass approximately 100% of the surface area defined by the intermediate areas 374.

The thermal vents 350 may have any size or shape depending on the particular application. FIG. 6 illustrates different examples of thermal vents 350. Optionally, different intermediate areas 374 may have differently sized and shaped thermal vents 350. Alternatively, each of the intermediate areas 374 may have similarly sized and shaped thermal vents 350. In some embodiments, the thermal vents 350 may be rectangular in shape. In other embodiments, the thermal vents 350 may be circular in shape. Other shapes are possible in alternative embodiments. In some embodiments, a particular intermediate area 374 may have a series of thermal vents 350 extending through the printed circuit board 340, with circuit board material between the various thermal vents 350. In other embodiments, a particular intermediate area 374 may have a single thermal vent 350 extending through the printed circuit board 340. Optionally, the thermal vents 350 may be positioned proximate to the edge of the intermediate area 374 such that thermal vents 350 are generally aligned with the divider walls 324. Airflow through the thermal vents 350 may flow through the lower wall 316 into the lower port 312 and generally along the divider wall 324 providing cooling for the divider wall 324, the lower port 312 and the pluggable module 104 in the lower port 312.

Figure 7:
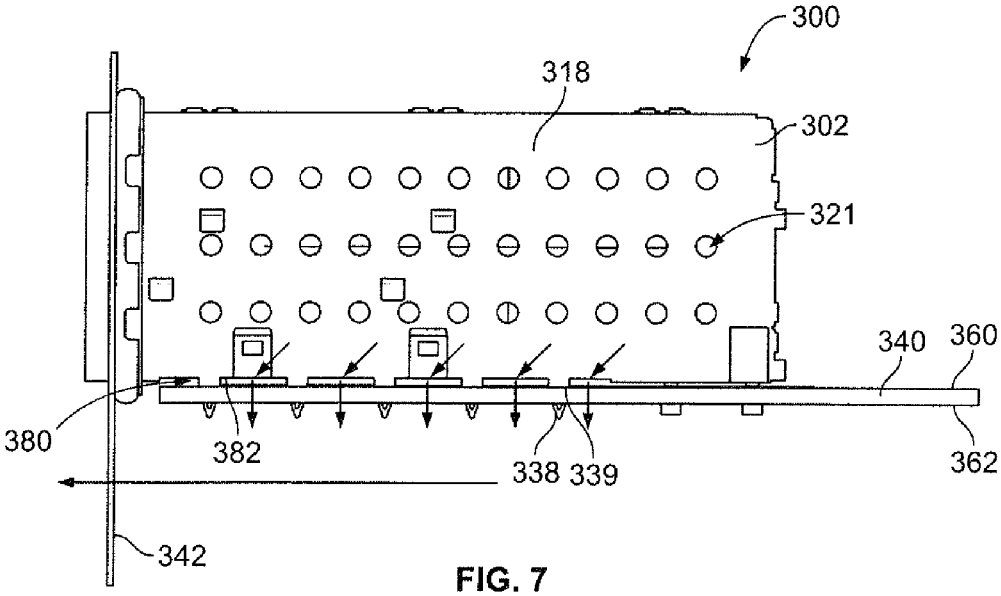
FIG. 7 is a side view of the electrical connector assembly shown in FIG. 4.
Figure 8:
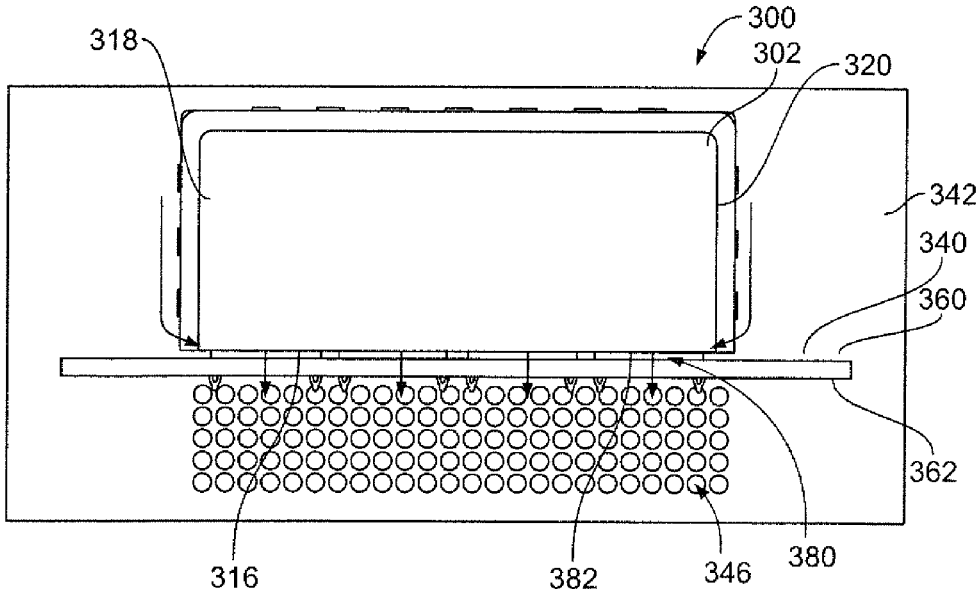
FIG. 8 is a front view of the electrical connector assembly shown in FIG. 4.

FIG. 7 is a side view of the electrical connector assembly 300. FIG. 8 is a front view of the electrical connector assembly 300. FIGS. 7 and 8 illustrate possible airflow patterns for airflow through the printed circuit board 340 and through the front bezel 342. As shown in FIG. 7, when the cage member 302 is mounted to the first surface 360 of the printed circuit board 340, an airflow space 380 is created between the cage member 302 and the first surface 360 of the printed circuit board 340. The cage member 302 may be purposely elevated above the first surface 360 to create the air flow space 380. For example, tines 338 of the cage member 302 are loaded into the printed circuit board 340 until shoulders 339 of the tines 338 engage the first surface 360. The shoulders 139 are spaced a distance below a bottom 382 of the cage member 302, to hold the bottom 382 off of the first surface 36. The bottom 382 may be defined by the lower edge of the side wall 318 or the bottom surface of the lower wall 316. The bottom 382 is elevated above the first surface 360 to create the airflow space 380 therebetween. Airflow through the airflow space 380 past the holes in any direction is possible and can promote improved cooling.

During use, air flows around the side walls 318, 320 under the cage member 302 and through the thermal vents 350 (shown in FIG. 5) to the bottom of the printed circuit board 350. In an exemplary embodiment, airflow may also be allowed through the airflow openings 321 (shown in FIG. 4) and/or the airflow openings in the interior walls into the ports 310, 312. Such airflow may then flow through the lower wall 316 into the airflow space 380. The bezel thermal vents 346 in the front bezel 342 promote and/or permit airflow below the second surface 362 of the printed circuit board 350. By increasing the airflow along the lower wall 316, the temperature of the pluggable modules 106 and the lower ports 312 may be reduced, which may increase the performance of such pluggable modules 106. The thermal vents 350 in the printed circuit board 340 tends to increase the airflow in the airflow space 380 below the bottom 382 of the cage member 302. The bezel thermal vents 346 tend to increase the airflow below the second surface 362 of the printed circuit board 340 which increases airflow through thermal vents 350.

The airflow direction may be reversed in alternative embodiments, flowing from the front of the front bezel 342 through the bezel thermal vents 346 to the area below the second surface 362 of the printed circuit board 340. The air then flows through the thermal vents 350 in the printed circuit board 340 across the bottom 382 of the cage member 302 and out the sides of the cage member 302.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector assembly comprising:

a cage member having a plurality of walls defining an upper port and a lower port configured to receive pluggable modules therein, the walls being manufactured from a metal material and providing electrical shielding for the upper port and the lower port, the cage member having openings in a front thereof for receiving the pluggable modules;

a receptacle connector received in the cage member proximate to a rear thereof, the receptacle connector being accessible through at least one of the upper port and the lower port; and a printed circuit board having a first surface and a second surface, the receptacle connector being terminated to the printed circuit board, the cage member being coupled to the printed circuit board, the printed circuit board having at least one thermal vent extending therethrough between the first and second surfaces, the at least one thermal vent providing cooling for the lower port.

2. The electrical connector assembly of claim 1, wherein the thermal vent allows airflow through the printed circuit board.

3. The electrical connector assembly of claim 1, wherein the thermal vent is aligned directly below the lower port.

4. The electrical connector assembly of claim 1, wherein the thermal vent is positioned forward of the receptacle connector.

5. The electrical connector assembly of claim 1, wherein the printed circuit board has a front edge, the printed circuit board includes a connector mounting area remote from the front edge with an intermediate area defined between the front edge and the connector mounting area, the thermal vent being provided through the intermediate area.

6. The electrical connector assembly of claim 1, wherein the cage member has a footprint on the printed circuit board, the thermal vent being positioned inside the area defined by the footprint.

7. The electrical connector assembly of claim 1, wherein the cage member has a footprint on the printed circuit board, the thermal vent encompassing at least 50% of the surface area defined by the footprint.

8. The electrical connector assembly of claim 1, wherein the at least one thermal vent comprises a plurality of thermal vents.

9. The electrical connector assembly of claim 1, wherein one of the plurality of walls of the cage member constitutes a lower wall extending along the bottom of the lower port between the front of the cage member and the receptacle connector, the thermal vent being aligned below the lower wall.

10. The electrical connector assembly of claim 1, wherein one of the plurality of walls of the cage member constitutes a lower wall extending along the bottom of the lower port between the front of the cage member and the receptacle connector, the lower wall having a plurality of airflow openings therethrough allowing airflow between the thermal vent and the lower port.

11. The electrical connector assembly of claim 1, wherein the cage member includes a plurality of upper ports and a plurality of lower ports, at least one of the lower ports defining an interior lower port, the thermal vent being aligned below the interior lower port.

12. The electrical connector assembly of claim 1, wherein the cage member includes a plurality of upper ports and a plurality of lower ports, the plurality of walls including at least one interior wall separating adjacent lower ports, the thermal vent being aligned with the interior wall allowing airflow along the interior wall.

13. An electrical connector assembly comprising:

a cage member having a plurality of walls defining an upper port and a lower port configured to receive pluggable modules therein, the walls being manufactured from a metal material and providing electrical shielding for the upper port and the lower port, the cage member having openings in a front thereof for receiving the pluggable modules;

a receptacle connector received in the cage member proximate to a rear thereof, the receptacle connector being accessible through at least one of the upper port and the lower port;

a printed circuit board having a first surface and a second surface, the receptacle connector being terminated to the printed circuit board, the cage member being coupled to the printed circuit board, the printed circuit board having at least one thermal vent extending through the printed circuit board between the first and second surfaces, the thermal vents providing cooling for the lower port; and a front bezel having an assembly opening therethrough, the printed circuit board and cage member being mounted behind the front bezel with the front of the cage member extending through the assembly opening, the front bezel having at least one bezel thermal vent therethrough, the bezel thermal vent being positioned below the assembly opening and below the printed circuit board.

14. The electrical connector assembly of claim 13, wherein the thermal vent allows airflow through the printed circuit board.

15. The electrical connector assembly of claim 13, wherein the printed circuit board has a front edge, the printed circuit board includes a connector mounting area remote from the front edge with an intermediate area defined between the front edge and the connector mounting area, the thermal vent being provided through the intermediate area.

16. The electrical connector assembly of claim 13, wherein the cage member has a footprint on the printed circuit board, the thermal vent being positioned inside the area defined by the footprint.

17. The electrical connector assembly of claim 13, wherein one of the plurality of walls of the cage member constitutes a lower wall extending along the bottom of the lower port between the front of the cage member and the receptacle connector, the thermal vent being aligned below the lower wall.

18. An electrical connector assembly comprising:

a printed circuit board having a first surface and a second surface, the printed circuit board having at least one thermal vent extending therethrough between the first and second surfaces;

a receptacle connector mounted to the first surface of the printed circuit board, the receptacle connector being configured to be mated with a transceiver module; and a cage member mounted to the first surface of the printed circuit board, the cage member having a plurality of walls defining a port receiving the receptacle connector and configured to receive the transceiver module therein, the walls being manufactured from a metal material and providing electrical shielding for the port, the cage member being mounted to the printed circuit board such that an airflow space is created between a bottom of the cage member and the first surface of the printed circuit board, the airflow space being in fluid communication with the at least one thermal vent of the printed circuit board.

19. The electrical connector assembly of claim 18, wherein the cage member includes a plurality of tines extending from a bottom of the cage member, the tines having shoulders configured to engage the printed circuit board, the shoulders spaced apart form the bottom such that the bottom is elevated above the first surface of the printed circuit board to define the airflow space.

20. The electrical connector assembly of claim 18, wherein the printed circuit board has a front edge, the printed circuit board includes a connector mounting area remote from the front edge with an intermediate area defined between the front edge and the connector mounting area, the thermal vent being provided through the intermediate area.

* * * * *